US008096121B2

(12) United States Patent
Gilton

(10) Patent No.: US 8,096,121 B2
(45) **Date of Patent: *Jan. 17, 2012**

(54) MICRO-MACHINE AND A METHOD OF POWERING A MICRO-MACHINE

(75) Inventor: Terry L. Gilton, Boise, ID (US)

(73) Assignee: pSiFlow Technologies, Inc., Boise, ID (US)

( * ) Notice: Subject to any disclaimer, the term of this patent is extended or adjusted under 35 U.S.C. 154(b) by 1084 days.

This patent is subject to a terminal disclaimer.

(21) Appl. No.: 11/452,185

(22) Filed: Jun. 13, 2006

(65) Prior Publication Data

US 2006/0254277 A1 Nov. 16, 2006

Related U.S. Application Data

(63) Continuation of application No. 10/847,235, filed on May 17, 2004, now Pat. No. 7,146,814.

(51) Int. Cl.
*F03C 1/00* (2006.01)

(52) U.S. Cl. ..... 60/531; 60/671

(58) Field of Classification Search ..... 60/530, 60/531, 651, 670, 671

See application file for complete search history.

(56) References Cited

U.S. PATENT DOCUMENTS 4,165,614 A 8/1979 Yeh
4,186,559 A 2/1980 Decker et al.
4,240,257 A 12/1980 Rakowsky et al.
4,252,185 A 2/1981 Kosson
4,546,608 A 10/1985 Shiina et al.
5,013,954 A 5/1991 Shibaike et al.
5,237,827 A * 8/1993 Tchernev ..... 62/106
5,481,188 A 1/1996 Mizutani
5,622,055 A * 4/1997 Mei et al. ..... 62/113
5,816,313 A 10/1998 Baker (Continued)

OTHER PUBLICATIONS

Sniegowski, J.J. et al., "Surface Micromachined Gear Trains Driven by an On-Chip Electrostatic Microengine," pp. 1-4.

(Continued)

*Primary Examiner* — Hoang Nguyen
(74) *Attorney, Agent, or Firm* — Perkins Coie LLP

(57) ABSTRACT

A rotatable micro-machine is comprised of a solvent reservoir, a porous evaporation region and a channel connecting the solvent reservoir to the evaporation region. The evaporation region may be constructed of capillary paths that enable a capillary action which pulls solvent from the channel so as to enable a flow of solvent from the reservoir to the evaporation region through the channel. A rotatable member has portions in communication with the channel so as to be rotated by the flow. In one embodiment, the rotatable member may be a component of a micro-turbine generator. A system may be comprised of the rotatable micro-machine in combination with at least one electrical circuit. The porous region may be positioned to receive heat from the circuit. That may be accomplished in several ways; the evaporation region may be formed adjacent to the circuit, the evaporation region may be fabricated on the side of a die that is opposite of the side of the die carrying the circuit, or the reservoir, micro-turbine generator, evaporation region, and channel may be fabricated on one die and the circuit fabricated on another die. The two dies may then be connected to one another by a heat transferring adhesive with the evaporation region proximate to the circuit. Methods of operating a rotatable micro-machine are also disclosed. Because of the rules governing abstracts, this abstract should not be used in construing the claims.

14 Claims, 1 Drawing Sheet

U.S. PATENT DOCUMENTS

| | | | | |
|---|---|---|---|---|
| 5,932,940 | A * | 8/1999 | Epstein et al. | 310/40 MM |
| 5,990,473 | A | 11/1999 | Dickey et al. | |
| 6,029,742 | A * | 2/2000 | Burward-Hoy | 165/80.4 |
| 6,234,618 | B1 | 5/2001 | Yamamoto et al. | |
| 6,305,779 | B1 | 10/2001 | Capurso et al. | |
| 6,494,043 | B1 * | 12/2002 | Choroszylow et al. | 60/772 |
| 6,495,944 | B2 | 12/2002 | Hirano et al. | |
| 6,574,963 | B1 | 6/2003 | Tadayon et al. | |
| 6,598,397 | B2 * | 7/2003 | Hanna et al. | 60/651 |
| 6,834,511 | B2 * | 12/2004 | Hatakeyama | 62/173 |
| 6,841,891 | B1 | 1/2005 | Luchinskiy et al. | |
| 6,857,269 | B2 * | 2/2005 | Baker | 60/653 |
| 6,877,318 | B2 * | 4/2005 | Tadayon et al. | 60/651 |
| 6,918,254 | B2 | 7/2005 | Baker | |
| 7,146,814 | B2 * | 12/2006 | Gilton | 60/651 |
| 7,524,392 | B2 * | 4/2009 | Usui | 156/305 |
| 2003/0170916 | A1 | 9/2003 | Gilton | |

OTHER PUBLICATIONS

Hardin, W., "Microengines are much more than scientific curiosity," OE Reports, No. 190, pp. 1-7, Oct. 1999.

Epstein, A.H. et al., "Power MEMS and Micronengines," IEEE Tranducers '97 Conference, Chicago, IL, pp. 1-4, Jun. 1997.

* cited by examiner

MICRO-MACHINE AND A METHOD OF POWERING A MICRO-MACHINE

The present application is a continuation of U.S. patent application Ser. No. 10/847,235 filed 17 May 2004 now U.S. Pat. No. 7,146,814 and entitled Micro-Machine and a Method of Powering a Micro-Machine.

BACKGROUND

The present disclosure is directed broadly to micro-electromechanical systems (MEMS) devices and, more particularly, to rotating devices built using MEMS technology.

MEMS technology borrows heavily from the field of solid state electronics manufacturing. Using the same or similar steps used by electronics manufacturers, gears with teeth measured in the tens of microns have been fabricated. The ability to fabricate gears and other moving parts on such small scales has led to the creation of micro-engines and micro-turbines.

The invention disclosed in U.S. Pat. No. 5,932,940 provides a micro-gas turbine engine and associated micro-componentry. The engine components, including, e.g., a compressor, a diffuser having diffuser vanes, a combustion chamber, turbine guide vanes, and a turbine are each manufactured by, e.g., micro-fabrication techniques, of a structural material common to all of the elements, e.g., a micro-electronic material such as silicon or silicon carbide. Vapor deposition techniques, as well as bulk wafer etching techniques, can be employed to produce the engine. The engine includes a rotor having a shaft with a substantially untapered compressor disk on a first end, defining a centrifugal compressor, and a substantially untapered turbine disk on the opposite end, defining a radial inflow turbine. The rotor is preferably formed of a material characterized by a strength-to-density ratio that enables a rotor speed of at least about 500,000 rotations per minute. An annular, axial-flow combustion chamber is provided that is located axially between the compressor and turbine disks and that has a ratio of annular height to axial length of at least about 0.5. The micro-gas turbine engine can be configured with an integral micro-generator as a source of electrical power, and can be employed for a wide range of power, propulsion, and thermodynamic cycle applications.

Problems associated with such small devices include controlling the supply of fuel and controlling parameters such as temperature and pressure needed to insure proper combustion, among others.

BRIEF SUMMARY

One aspect of the present disclosure is directed to a rotatable micro-machine comprising a solvent reservoir, a porous evaporation region and a channel connecting the solvent reservoir to the evaporation region. The evaporation region may be constructed of capillary paths that enable a capillary action which pulls solvent from the channel so as to enable a flow of solvent from the reservoir to the evaporation region through the channel. A rotatable member has portions in communication with the channel so as to be rotated by the flow. In one embodiment, the rotatable member may be a component of a micro-turbine generator.

Another aspect of the present disclosure is directed to a system comprising at least one electrical circuit, a solvent reservoir, an evaporation region and a channel connecting the solvent reservoir to the evaporation region. The evaporation region may be constructed of capillary paths that enable a capillary action which pulls solvent from the channel so as to enable a flow of solvent from the reservoir to the evaporation region through the channel. A micro-generator is in communication with the channel so as to be rotated by the flow. A controller is responsive to the generator for supplying power to the circuit. The porous region may be positioned to receive heat from the circuit. That may be accomplished in several ways; the evaporation region may be formed adjacent to the circuit, the evaporation region may be fabricated on the side of the die that is opposite of the side of the die carrying the circuit, or the reservoir, micro-turbine generator, evaporation region, and channel may be fabricated on one die and the circuit fabricated on another die. The two dies may then be connected to one another by a heat transferring adhesive with the evaporation region proximate to the circuit.

A method of operating a rotatable micro-machine is also disclosed. The method may comprise powering a micro-machine with a flow between a reservoir and an evaporation region produced by capillary forces. Additionally, heat may be applied to the evaporation region.

A method of operating a system is also disclosed. The method may comprise powering a micro-turbine generator with a flow between a reservoir and an evaporation region produced by capillary forces and supplying power produced by the micro-turbine generator to a circuit. The method may additionally comprise operating the micro-turbine generator as a pump until the circuit begins producing heat.

BRIEF DESCRIPTION OF THE DRAWINGS

For the present invention to be easily understood and readily practiced, the present invention will now be described, for purposes of illustration and not limitation, in conjunction with the following figures, wherein.

DETAILED DESCRIPTION

Figure 1:
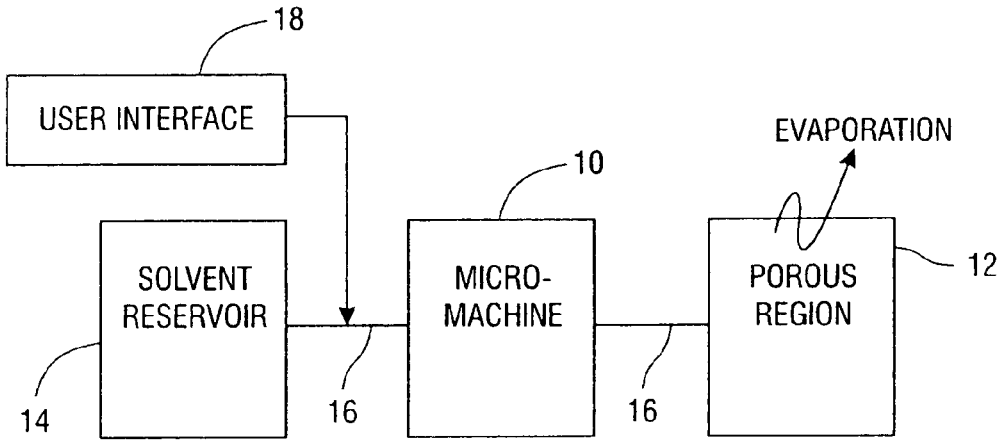
FIG. 1 is a block diagram illustrating an embodiment of the present invention.

The present disclosure is directed to a micro or nano-machine and a method of powering such a machine using capillary fluid forces. As shown in FIG. 1, the structure involves a rotatable micro-machine 10 which may range from a single rotatable micro-gear to a complicated device such as a micro-turbine generator. It should be noted that process steps for fabricating such devices are not disclosed herein as such steps are known in the art as shown by, for example, the aforementioned U.S. Pat. No. 5,932,940, the entirety of which is hereby incorporated by reference.

On one side of the micro-machine 10 is an evaporation region 12 which may be exposed to the ambient atmosphere. The evaporation region 12 may take the form of a porous region comprised of a plurality of capillary paths. On the other side of the micro-machine 10 is a solvent reservoir 14, which may have an input area (not shown) open to ambient. The surface area of the evaporation region 12 exposed to ambient is larger than the surface area of the input area of the reservoir, e.g. by a margin of two to one. The solvent is chosen to have a high vapor pressure and thus a large evaporation rate. Connecting the solvent reservoir 14 to the evaporation region 12 is a channel 16. Portions of the micro-machine 10, such as vanes, blades, or the like (shown in FIG. 2), are in communication with the channel 16. A user interface 18 may be provided for controlling a device, e.g. a valve (shown in FIG. 2), for regulating flow within channel 16.

As the solvent evaporates from a surface of the evaporation region 12 exposed to ambient, the solvent remaining within the evaporation region 12 will be drawn to those locations from which the solvent has evaporated as a result of capillary forces within the evaporation region 12. The redistribution of solvent will cause solvent to be pulled from the channel 16. The solvent pulled from channel 16 will be replaced by solvent from the reservoir 14 thus causing a flow through channel 16 which will drive or power the micro-machine 10. The micro-machine can be used to drive other parts of a structure or generate small amounts of electrical current by causing a magnetic part to move past a wire. The evaporation region 12 will cool, which cooling may be useful elsewhere in the system as will be described below in conjunction with FIG. 2.

The evaporation region 12 may take the form, as noted above, of a porous region. Such a porous region may be made by lithographically opening a pattern in a layer of resist where the substrate is to be made porous. The porous evaporation region 12 may be, for example, 100 μm on a side. The substrate may be formed of silicon, which is then implanted with another material in the area opened in the layer of resist. The resist is stripped and the substrate is anodized using known techniques to form the region 12. See, for example, U.S. 2003/0170916A1 published Sep. 11, 2003 and entitled Methods for Fabricating Separation Apparatus, the entirety of which is hereby incorporated by reference. Alternatively, a recess of the size desired for the porous evaporation region 12 may be formed in the substrate, and the recess filled with a high surface area material like hemispherical grain silicon (HSG). The precise method used to form the porous evaporation region 12 is not an important aspect of the present invention.

Figure 2:
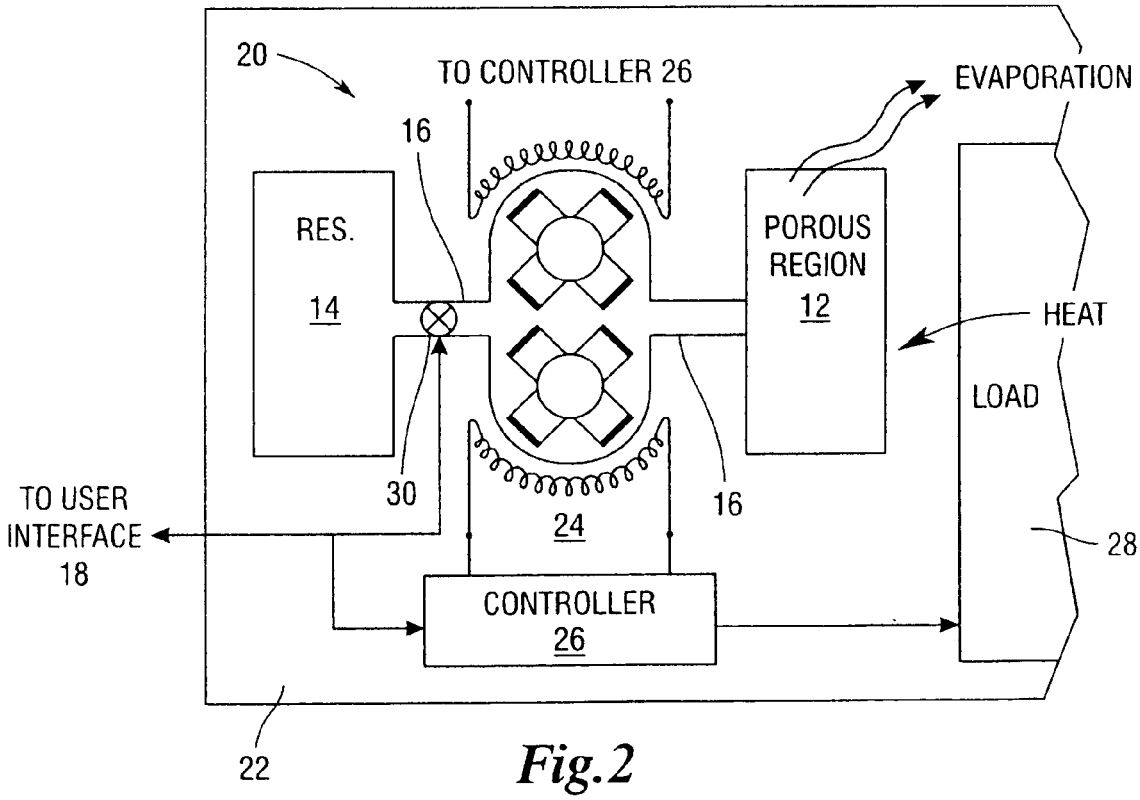
FIG. 2 is a block diagram illustrating another embodiment of the present invention.

Turning now to FIG. 2, another embodiment of the present invention is disclosed. In FIG. 2, like components carry the same reference numbers as in FIG. 1. FIG. 2 illustrates a system 20 fabricated on die 22. A micro-machine, in this case a micro-turbine generator 24, is provided so as to be driven by the flow within channel 16. The power generated by the micro-turbine generator 24 is input to a controller 26.

Die 22 also carries at least one electrical circuit 28. The electrical circuit may be a part of a more complicated device such as a memory device, receiver, transmitter, camera, phone, PDA, etc. The controller 26 provides power to the electrical circuit 28. The evaporation region 12 may be, but need not be depending on the solvent, positioned so as to absorb heat produced by the electrical circuit 28. Finally, a valve 30 may be provided within channel 16 with the valve ultimately responsive to user input.

Positioning the evaporation region 12 and/or positioning the circuit 28 so that the evaporation region 12 may absorb heat from circuit 28 may be accomplished in several ways. For example, the evaporation region 12 may be formed adjacent to the circuit 28, the evaporation region 12 may be fabricated on the side of the die 22 that is opposite of the side of the die carrying the circuit 28, or the reservoir 14, micro-turbine generator 24, evaporation region 12, and channel 16 may be fabricated on one die and the circuit 28 fabricated on another die. The two dies may then be connected to one another by a heat transferring adhesive with the evaporation region 12 proximate to the circuit 28.

Several methods of operating the system 20 may be implemented by proper selection of a solvent. For example, if a solvent is selected which will evaporate without the addition of any heat from circuit 28, then all that need be done to begin powering micro-turbine generator 24 is to open the valve 30. Alternatively, if the solvent is chosen such that heat is needed before evaporation occurs, then a battery (not shown) or other power source will be needed to initially power circuit 28. Power from the battery or other source may also be input to the micro-turbine generator 24 through the controller 26 so that the micro-turbine generator 24 initially acts as a pump. After the circuit 28 begins to produce heat, the evaporation and resulting capillary flow will power the micro-turbine generator 24 such that the battery or other power source may be disconnected from both the controller 26 and the circuit 28.

While the present invention has been described in connection with preferred embodiments thereof, those of ordinary skill in the art will recognize that many modifications and variations are possible. The present invention is intended to be limited only by the following claims and not by the foregoing description which is intended to set forth the presently preferred embodiments.

What is claimed is:

1. A micro-machine comprising:

a solvent reservoir;

a porous evaporation region configured to divert a solvent out of the machine to ambient;

a micro-channel configured to flow solvent from said solvent reservoir to said evaporation region, wherein said flow is controlled by a valve; and a micro-member located within said micro-channel capable of being rotated by solvent flow through said micro-channel.

2. The micro-machine of claim 1 further comprising a generator wherein said micro-member is a micro-turbine connected to said generator.

3. The micro-machine of claim 1 wherein said solvent reservoir, evaporation region, micro-channel, and micro-member are fabricated on a die.

4. A micro-machine comprising:

a solvent reservoir;

an evaporation region configured to divert a solvent out of the machine to ambient;

a micro-channel connecting said solvent reservoir and said evaporation region;

a micro-turbine generator having a micro-turbine positioned within said micro-channel, said micro-turbine capable of being rotated by a solvent flow through said micro-channel from the solvent reservoir;

a valve configured to control the solvent flow, the valve being operably coupled to a user interface; and a controller responsive to said micro-turbine generator.

5. The system of claim 4 wherein said solvent reservoir, evaporation region, micro-channel, and micro-turbine generator are fabricated on a die.

6. A system comprising:

at least one electrical circuit;

a solvent reservoir;

an evaporation region configured to divert a solvent out of the system to ambient;

a micro-channel connecting said solvent reservoir and said evaporation region;

a micro-turbine generator having a micro-turbine positioned within said micro-channel, said micro-turbine capable of being rotated by solvent flow through said micro-channel to the evaporation region;

a valve configured to control said solvent flow;

a controller responsive to said micro-turbine generator capable of supplying power to said circuit; and a user interface operably coupled to the valve and the controller and configured to provide user control of the valve.

7. The system of claim 6 wherein said evaporation region is positioned to receive heat from said circuit.

8. The system of claim 6 wherein said solvent reservoir, evaporation region, micro-channel, and micro-turbine generator are carried on a first side of a die and said circuit is carried on a second side of said die such that said evaporation region is proximate to said circuit.

9. The system of claim 6 wherein said solvent reservoir, evaporation region, channel, and micro-generator are carried on a first die and said circuit is carried on a second die, said first and second dies being connected such that said evaporation region is proximate to said circuit.

10. The system of claim 9 wherein said first and second dies are connected by a heat transferring adhesive.

11. The system of claim 6 further comprising a power source connected to said circuit to initially power said circuit.

12. The system of claim 6 further comprising a power source connected to said micro-turbine generator such that said micro-turbine generator initially acts as a pump.

13. A method comprising:

providing solvent to a system having a micro-member located within a micro-channel between a solvent reservoir and a porous evaporation region, wherein said porous evaporation region is configured to divert said solvent out of the system to ambient and wherein said a micro-member is capable of being rotated by solvent flow through said micro-channel;

controlling a flow of said solvent from said solvent reservoir to said porous evaporation region using a valve, thereby controlling rotation of said micro-member.

14. The method of claim 13, wherein said rotation of said micro-member is utilized for power generation.

* * * * *

UNITED STATES PATENT AND TRADEMARK OFFICE

CERTIFICATE OF CORRECTION

PATENT NO. : 8,096,121 B2
APPLICATION NO. : 11/452185
DATED : January 17, 2012
INVENTOR(S) : Terry L. Gilton It is certified that error appears in the above-identified patent and that said Letters Patent is hereby corrected as shown below:

Title Page, item (73), please delete "pSiFlow Technologies, Inc.," and insert -- pSiFlow Technology, Inc., --, therefor.

On Page 2, item (56), Column 2, Lines 3-4, under "OTHER PUBLICATIONS", please delete "Micronengines," IEEE Tranducers" and insert -- Microengines," IEEE Transducers --, therefor.

Signed and Sealed this
First Day of May, 2012

David J. Kappos

David J. Kappos
*Director of the United States Patent and Trademark Office*